United States Patent [19]

Pagano

[11] 4,291,417

[45] Sep. 29, 1981

[54] PROTECTIVE HEAD COVERING

[76] Inventor: Alice L. Pagano, 816 S. Verdugo Rd., #1, Glendale, Calif. 91205

[21] Appl. No.: 84,326

[22] Filed: Oct. 12, 1979

Related U.S. Application Data

[63] Continuation-in-part of Ser. No. 940,792, Sep. 7, 1978, abandoned.

[51] Int. Cl.[3] ..... A42B 1/04; A42B 1/18; A42B 1/20

[52] U.S. Cl. ..... 2/202

[58] Field of Search ..... 2/202, 205, 2.1 A, 6, 2/8, 9, 10, 11, 171, 198

[56] References Cited

U.S. PATENT DOCUMENTS

| | | | |
|---|---|---|---|
| 1,398,165 | 11/1921 | Whiteside . | |
| 2,140,647 | 12/1938 | Myers . | |
| 3,026,525 | 3/1962 | Gyorfy | 2/8 |
| 3,514,785 | 6/1970 | Smith | 2/6 X |
| 3,708,803 | 1/1973 | Teaff | 2/198 |
| 3,951,160 | 4/1976 | Nitu . | |

FOREIGN PATENT DOCUMENTS

| | | | |
|---|---|---|---|
| 243400 | 2/1912 | Fed. Rep. of Germany | 2/8 |
| 398134 | 3/1909 | France | 2/202 |
| 151040 | 8/1955 | Sweden | 2/202 |
| 1896 of 1913 | | United Kingdom | 2/202 |

*Primary Examiner*—Peter P. Nerbun

*Attorney, Agent, or Firm*—Nilsson, Robbins, Dalgarn, Berliner, Carson & Wurst

[57] ABSTRACT

A collapsible protective covering assembly for protecting the head of a bearer includes a collapsible frame, a flexible shield mounted on the frame and a garment collar for attachment of the frame and shield to the garment. The frame includes a front base member, which with the collar as a matching base member, forms a base for the assembly, and also includes a plurality of ribs. Snaps are employed to detachably attach the frame and protective shield to the collar. The front base member has an open configuration with respect to a rib for spreading a front portion of the shield (a face shield) in a protective configuration and a collapsed configuration with respect to the rib for bunching the front portion in a non-protective configuration. Each rib similarly has an open configuration with respect to another rib for spreading a portion of the shield in a protective configuration, and a collapsed configuration for bunching the portion in a collapsed configuration. The frame, including the front base member and the ribs, may be completely collapsed to bunch a number of portions of the shield.

2 Claims, 6 Drawing Figures

FIG. 4
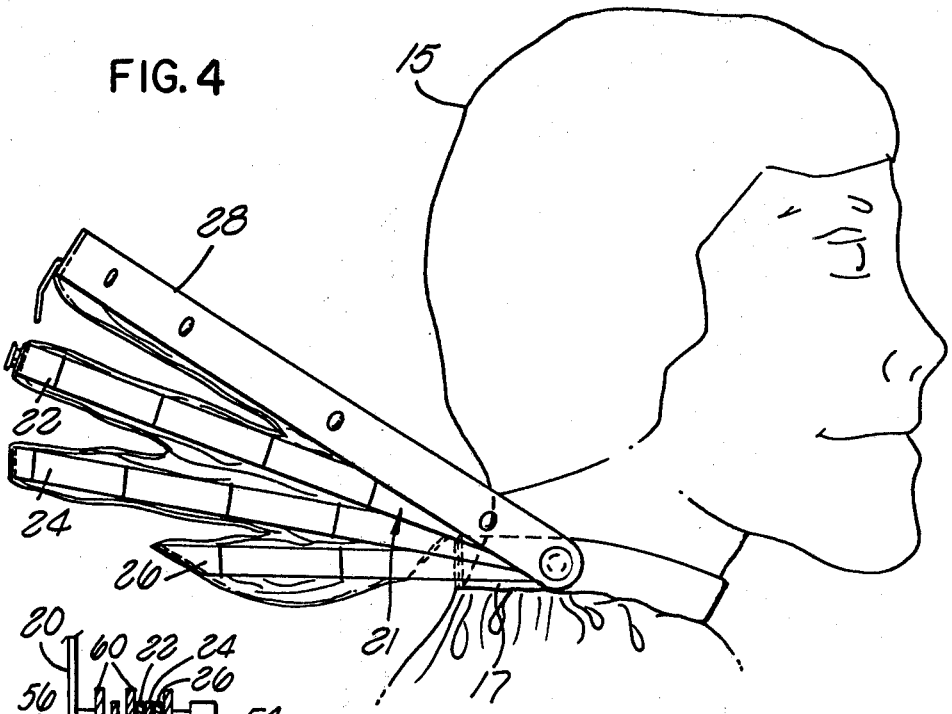
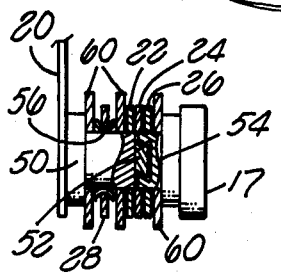
FIG. 6
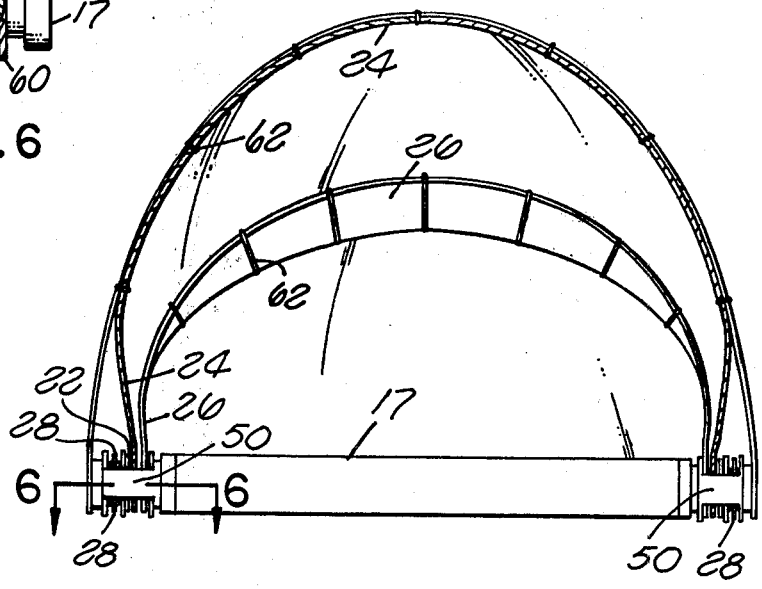
FIG. 5

PROTECTIVE HEAD COVERING

CROSS-REFERENCE TO RELATED APPLICATION

This application is a continuation-in-part of application Ser. No. 940,792, filed Sept. 7, 1978, now abandoned.

FIELD OF THE INVENTION

This invention relates to protective coverings to be worn by an individual, more particularly to such coverings which protect a bearer from inclement weather.

BACKGROUND AND SUMMARY OF THE INVENTION

Umbrellas and rain hats have long been used to protect individuals from rain and other weather conditions. Certainly in part as a result of the universality of the need, a significant amount of effort has been directed toward developing advantageous ways to provide such protection.

Four somewhat varied approaches are disclosed in Deluermoz French Pat. No. 398,134, Nitu U.S. Pat. No. 3,951,160, Whiteside U.S. Pat. No. 1,398,165, and Myers U.S. Pat. No. 2,140,647. Thus, in Deleurmoz, a support brace rests on the shoulders of a bearer and support elements about the head of the bearer have cloth disposed thereover. The appearance when worn, apart from the shoulder brace, and the mode of use when worn, are comparable to a traditional bonnet. As with such bonnets, the face is left open to the effects of the wind and other elements. In Nitu, an inflatable, double-layered, ball-type "unbrella" is held to the body of a bearer by a cord disposed about the upper torso. The umbrella is inflated by trapping air between the layers which are welded together. In Whiteside, a cover for the upper part of the body is in the nature of a sack, held about the torso by a drawstring. In Myers, a somewhat conventional umbrella structure is mounted and supported on the head of a bearer and collapsible when removed from the head.

Teaff U.S. Pat. No. 3,708,803 is similar to Deluermoz, but in the specific context of a coiffure protector.

Although adapted for use as a protective helmet, e.g., for a welder, apparatus disclosed in Gyorfy U.S. Pat. No. 3,026,525 may have some relevance. Thus, a protective helmet supported on the head, includes a front mask of the type conventionally employed by a welder. A pleated hood, which expands and contracts as the mask is moved down and up, respectively, is employed with the mask, which may be detached from the hood. German Pat. No. 243,400 is somewhat similar in disclosing a member that may be disposed before the face or on top of the head of the bearer.

Smith U.S. Pat. No. 3,514,785, is of some limited interest in disclosing a helmet which is part of a space suit and which may be automatically triggered to dispose itself about the head of the bearer.

The present invention provides a protective head covering assembly incorporating a degree of convenience, simplicity and flexibility of significant advantage to a user.

In accordance with the invention, a protective covering assembly for protecting the head of a bearer, includes: a protective covering for the head of the bearer which incorporates a flexible protective shield, a collapsible frame, attached to the shield for supporting the shield about the head of the bearer, the frame including a plurality of support ribs for the shield attached to one another, and covering attaching means attached to the shield for attaching the covering to the garment; and garment attaching means attached to the garment, which incorporates means for mating with said covering attaching means to attach the covering to the garment.

The covering attaching means and garment attaching means may detachably attach to each other and, for example, include snaps for such purpose. Also, the frame may include a front base member or portion for the assembly, which is attached to the ribs, and the garment attaching means may include another base member or portion for the assembly, for example, including a collar for the garment. With the assembly in position, such base portions may encircle the bearer about the head region, with the front portion to the front of the bearer and the other portion to the rear of the bearer.

In accordance with other aspects of the invention, a collapsible protective covering assembly for protecting the head of a bearer includes: a flexible protective shield; and a collapsible frame attached to the shield for supporting the shield about the head of the bearer; wherein the frame has a first configuration for spreading the protective shield in a first configuration for protecting the head of the bearer and a second configuration for spreading the protective shield in a second configuration for protecting the head of the bearer.

In accordance with yet other aspects of the invention, a protective covering assembly for protecting the head of a bearer, includes: a base, incorporating a front base member; a plurality of ribs attached to the base; a flexible protective shield attached to the base and to the ribs, which has at least two protective and one non-protective configurations, and which includes a first flexible portion for shielding at least a part of the face of the bearer and a second flexible portion for shielding at least part of the remainder of the head of the bearer; wherein the base member has an open configuration with respect to a rib for spreading the first portion of the shield in a protective configuration and a collapsed configuration with respect to the rib for bunching the portion of the shield in a non-protective configuration; and wherein the ribs have an open configuration with respect to one another for spreading the second portion of the shield in a protective configuration and a collapsed configuration with respect to one another for bunching the portion in a non-protective configuration.

BRIEF DESCRIPTION OF THE DRAWINGS

FIG. 4 is the elevational view of FIG. 2 with the assembly essentially completely collapsed.

FIG. 5 is a cross-sectional view taken along the line 5—5 of FIG. 2, with, however, the bearer not shown.

FIG. 6 is a cross-sectional view taken along the line 6—6 of FIG. 5.

DETAILED DESCRIPTION

Figure 1:
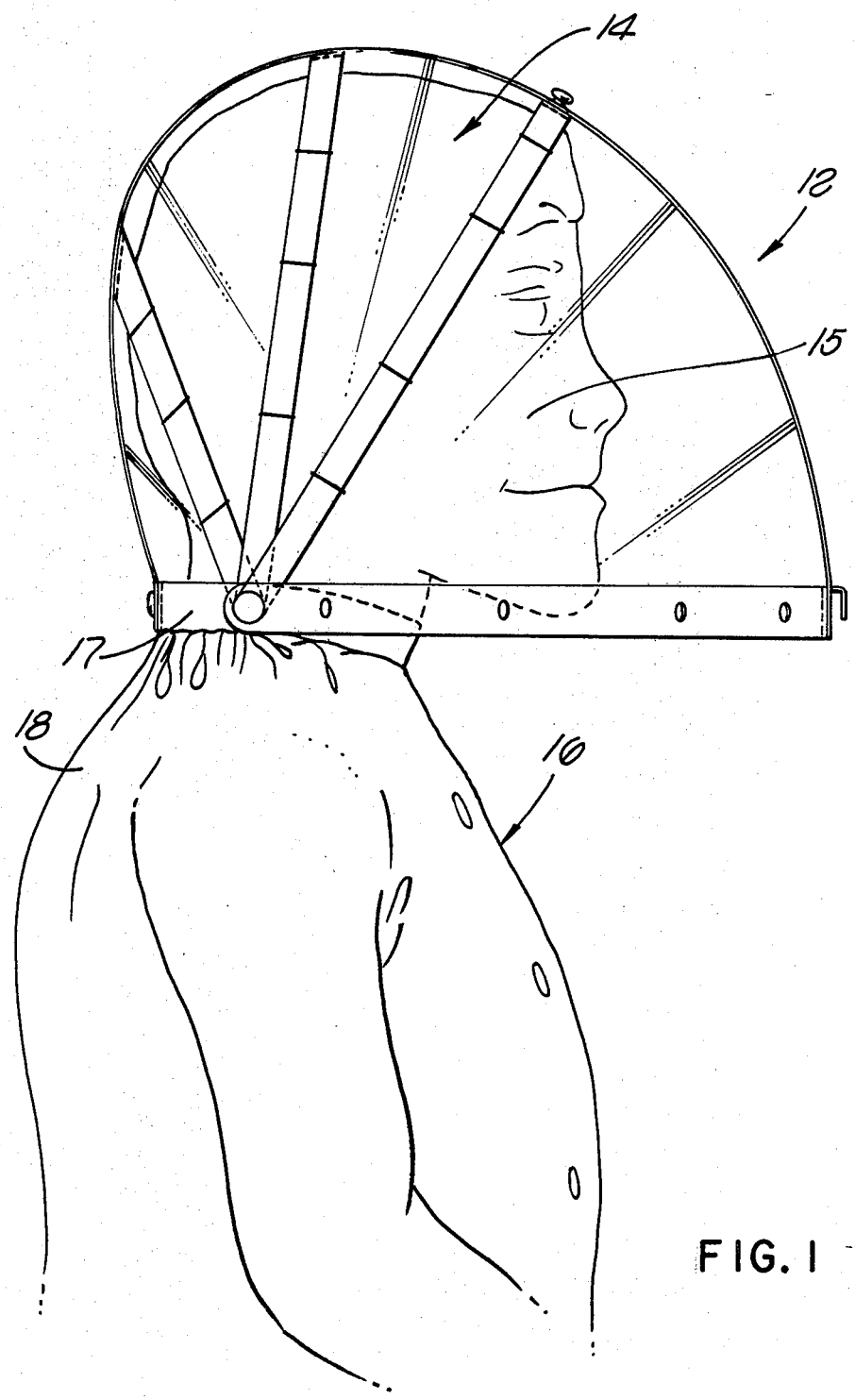
FIG. 1 is an elevational view showing a protective covering assembly in accordance with the invention on a bearer.

Referring to FIG. 1, a protective covering assembly 12 includes a protective head covering 14 to provide protection for the head 15 of a bearer 16 against, e.g., rain or other types of inclement weather. The assembly 12 also includes a collar 17 which, in the embodiment herein, is permanently attached (e.g., sewn) to a garment 18, which is in the nature of a coat, and also open (noncontinuous) at the front. The collar and protective head covering, by the use of snaps, may be readily attached to and detached from one another. If desired, the collar could similarly be made separable from the garment.

Figure 2:
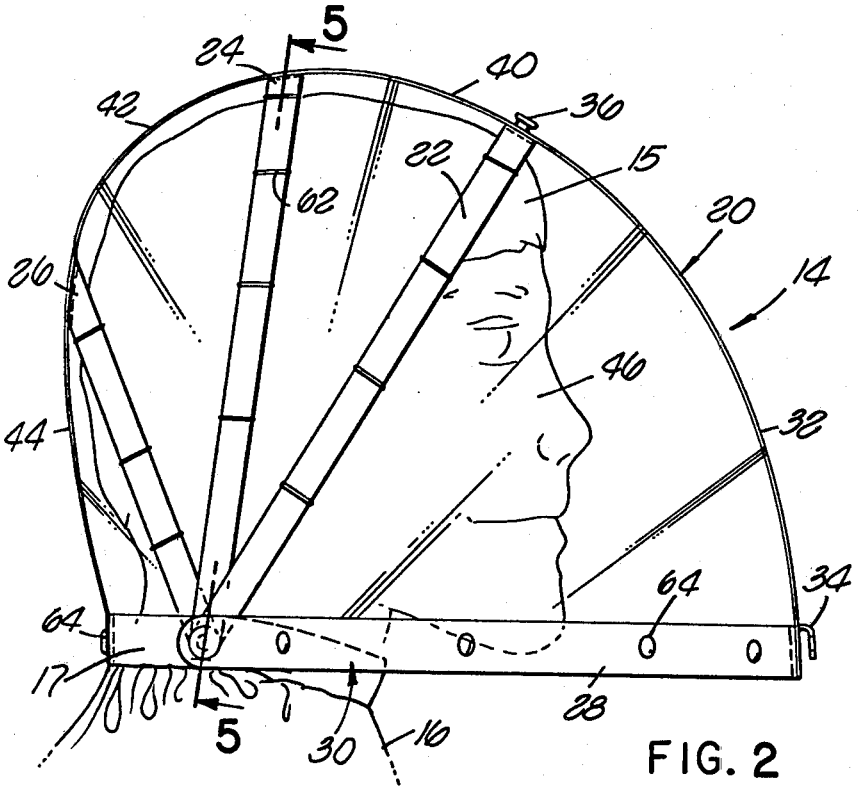
FIG. 2 is a part of the elevational view of FIG. 1.

Referring to FIG. 2, the protection by the protective head covering 14, is provided by a flexible shield 20, which might, e.g., be made of a clear plastic material, and which is mounted on a frame 21 (see FIG. 4). Such a clear material provides full visibility for the bearer in any desired direction. The frame includes front 22, middle 24 and rear 26 ribs which provide support for the shield about the head of the bearer, and a front base member or base portion 28 for the protective covering assembly 12 (see FIG. 1). The collar 17 acts as a matching base member or portion to form, with the front base member, a base 30 for the assembly, which in FIG. 2, encircles the bearer about the head region.

Figure 3:
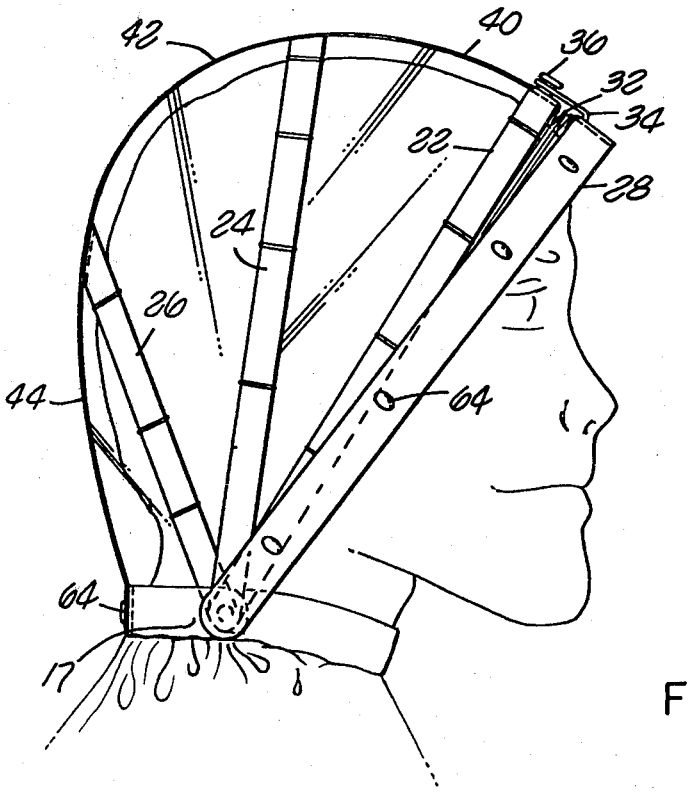
FIG. 3 is the elevational view of FIG. 2 with the assembly partially collapsed to bunch a face shield.

By reference to FIG. 3, it may be appreciated that the front base member 28 may be collapsed from its open configuration with respect to the front rib 22 of FIG. 2, to a collapsed configuration with respect to the front rib of FIG. 3, which results in the bunching of a face shield 32 (or front portion of the protective shield 20) in the non-protective configuration of the face shield shown in FIG. 3. The front base member and the face shield may be maintained in this configuration by passing a loop 34, e.g., made of plastic, over a button 36.

Referring to FIG. 4, it may similarly be appreciated that the front rib 22 may also be moved to a collapsed configuration with respect to the middle rib 24; the middle rib 24 may be moved to a collapsed configuration with respect to the rear rib 26; and the rear rib 26 may be moved to a collapsed configuration with respect to the collar 17.

By way of contrast, in FIG. 2, the front portion 32, a middle-front portion 40, a middle-rear portion 42 and a rear portion 44 of the flexible protective shield 20 are each spread in a protective configuration. In FIG. 3, the middle-front 40, the middle-rear 42 and rear 44 portions of the shield are spread in the protective configuration. Finally, in FIG. 4, none of the portions are spread in a protective configuration; they are all bunched in a non-protective configuration.

Although the embodiment shown is particularly adapted for use in the three ways shown in the figures, it may be appreciated that by readily implemented modifications, other ways of employing a similar protective covering (e.g., two portions in a protective and two in a non-protective configuration ) may be easily realized, such other ways including methods, for example, somewhat along the lines of what is used in the embodiment herein (see FIGS. 5 and 6), of connecting the ribs and base so that the ribs may be frictionally held in a variety of positions about the head of the bearer. In the embodiment shown, the capability of a portion of the shield to be disposed in a manner for protecting the face 46 of the bearer 16 or alternatively disposed in a non-protective manner, while leaving other portions of the shield essentially unaffected, is considered a significant advantage.

As is evident by the operations illustrated by FIGS. 2, 3 and 4, the front base member or portion 28 and collar 17 are rotatably attached to each other; and the ribs are each rotatably attached to the base 30 (and front base member and collar). As shown in FIGS. 5 and 6, this is accomplished in conventional fashion by passing headed pins 50 having snap elements 52 at their non-head ends (e.g., welded to the pins) through holes in the front base member 28, and in the front 22, middle 24 and rear 26 ribs along parts of the ribs which are near the base members. The snap elements associated with the pins are then mated with counterpart snap elements 54 which are secured to the collar 17. Eyelets 56 are used to line the holes through the front base member, and washers 60 protect the base from the ribs and pin heads as the ribs rotate. The collar 17 as well as the front base member 28 could conveniently be made of corduroy to, among other things, enhance the appearance of the assembly. The lightness and strength of aluminum make aluminum a convenient material for the ribs. It is of course evident that other conventional connections differing from that illustrated by FIG. 5, may readily be employed. It should also be evident that use of the collar 17 in the holding of the head covering 14 to the torso of the bearer incorporates an advantageous capability for freedom of head and torso movement independently of the head covering. Further, the association of the collar 17 with the coat 18 enhances the stability of the head covering when in position on the bearer.

Referring to FIGS. 2 and 5, in the embodiment shown, the shield is attached to the ribs by loops of thread 62; and the shield is also attached to the collar 17 and front base member 28 by snaps 64 (FIG. 2) which have snap elements attached to the collar 17, front base member 28 and to the shield. Among alternatives to what is shown relating to the loops of thread, the shield could be formed from pieces of material stitched together to form seams; and the loops of thread could be attached along flange-like parts of the material along which the stitching is provided. In addition, the loops could pass through holes in the ribs.

It is noted that where light-weight aluminum is used for the ribs and plastic for the shield, the head covering 14 will be exceedingly light. Where it is desired to stiffen the collar, the collar could be made tubular with a plastic or metallic reinforcing band therein having snap elements therealong extending through openings along the collar for the elements. Additionally, it is noted that the shield 20 could easily be provided with air holes, if desired. Also, holding strings, elastic holding bands, or other such items, though unnecessary in view of the attachment to the collar 17, could be provided.

It may be appreciated that the embodiment which has been described has been given by way of illustration and that many modifications and changes may be made without departing from the spirit of the invention.

I claim:

1. A protective covering assembly for protecting the head of a bearer and for attachment to a garment, comprising:

(a) a protective covering for the head of the bearer, including, (1) a flexible protective shield, (2) a collapsible frame attached to said shield for supporting said shield about the head of the bearer, said frame including a plurality of support ribs for said shield attached to one another and a front base portion for the assembly attached to said ribs, and (3) first covering attaching means attached to said shield for attaching said covering to the garment; and (b) second covering attaching means for attaching said covering to the garment, including, (1) a collar for the garment attached to the garment for attaching said covering to the garment, said collar comprising another base portion for the assembly, and (2) means for attachment to said collar and for mating with said first covering attaching means to attach said covering to the garment;

(c) said base portions being adapted to together encircle the bearer about the head region, said front portion to pass to the front of the bearer and said another portion to pass to the rear of the bearer, and being adapted for rotatable attachment to each other to permit said front portion to move before the face of the bearer with respect to said collar.

2. A protective covering assembly for protecting the head of a bearer and for attachment to a garment, comprising:

(a) a protective covering for the head of the bearer, including, (1) a flexible protective shield having at least two protective and one non-protective configurations, and including a first flexible portion for shielding at least a part of the face of the bearer and a second flexible portion for shielding at least part of the remainder of the head of the bearer, (2) a collapsible frame attached to said shield for supporting said shield about the head of the bearer, said frame including a plurality of support ribs for said shield attached to one another and a base member attached to said shield, said base member having an open configuration with respect to at least one of said ribs for spreading said first portion of said shield in a protective configuration and a collapsed configuration with respect to said rib for bunching said first portion in a non-protective configuration, said ribs having an open configuration with respect to one another for spreading said second portion of said shield in a protective configuration and a collapsed configuration with respect to one another for bunching said second portion in a non-protective configuration, and (3) first covering attaching means attached to said shield for attaching said covering to the garment; and (b) second covering attaching means for attaching said covering to the garment, including, (1) a collar for the garment attached to the garment for attaching said covering to the garment; and (2) means for attachment to said collar and for mating with said first covering attaching means to attach said covering to the garment.

* * * * *